US006945003B2

(12) United States Patent
Berry

(10) Patent No.: US 6,945,003 B2
(45) Date of Patent: Sep. 20, 2005

(54) MONUMENTAL, STAINLESS-STEEL CROSS WITH I-BEAM AND CABLE STRUCTURE

(76) Inventor: Jacob O. Berry, P.O. Box 9492, Amarillo, TX (US) 79105

( * ) Notice: Subject to any disclaimer, the term of this patent is extended or adjusted under 35 U.S.C. 154(b) by 195 days.

(21) Appl. No.: 10/394,610

(22) Filed: Mar. 21, 2003

(65) Prior Publication Data

US 2004/0182020 A1 Sep. 23, 2004

(51) Int. Cl.[7] ..... E04C 3/02
(52) U.S. Cl. ..... 52/648.1; 52/638; 52/653.1
(58) Field of Search ..... 52/648.1, 633, 52/100, 638, 653.1, 729.2, 319

(56) References Cited

U.S. PATENT DOCUMENTS 1,758,678 A * 5/1930 White ..... 52/633
1,764,182 A * 6/1930 Rawson ..... 52/633
1,915,023 A * 6/1933 Lizaso et al. ..... 52/648.1
2,084,648 A * 6/1937 Macmillan ..... 52/650.3
2,530,481 A * 11/1950 Rawn, Jr. ..... 220/683
4,638,609 A 1/1987 Csak
5,060,332 A 10/1991 Webster
5,208,932 A 5/1993 Muller
5,505,035 A * 4/1996 Lalvani ..... 52/648.1
5,802,772 A * 9/1998 Burke et al. ..... 52/6
5,848,499 A 12/1998 Schildge, Jr.
6,158,182 A 12/2000 Biebuyck
D440,734 S 4/2001 Berry
6,543,198 B1 * 4/2003 Kubik ..... 52/648.1

FOREIGN PATENT DOCUMENTS

FR 164364 9/1884

* cited by examiner

*Primary Examiner*—Brian E. Glessner
*Assistant Examiner*—Basil Katcheves

(57) ABSTRACT

This concerns a 1000 foot stainless-steel Cross. This is a multi-faceted building including an I-beam internal structure for the tower and the arms, a cable structure within and without the building, and stainless-steel panels as the external "skin" of the building.

1 Claim, 7 Drawing Sheets

MONUMENTAL, STAINLESS-STEEL CROSS WITH I-BEAM AND CABLE STRUCTURE

BACKGROUND OF THE INVENTION

1. Field of the Invention

The present invention relates to monuments, and more particularly, to a cable structure, I-beam structure, and stainless-steel exterior monument.

2. Description of Prior Art

There are five different monument-attractions that have definite similarities to this Cross, to wit: the Eiffel Tower in Paris, the Statue of Liberty, the St. Louis or Gateway Arch, the Washington Monument, and the Stratosphere Tower in Las Vegas.

The Eiffel Tower was built from January 1887 to May 1889. It is approximately 1000 feet tall and stands on four giant legs. On Sep. 18, 1884 Eiffel registered a patent "for a new configuration allowing the construction of metal supports and pylons capable of exceeding a height of 300 meters". It was built of iron, using "x" braces to support the structure from the bottom to the top. There were 18,000 elements which made up the Tower, and two-and-a-half million rivets assembling the elements. It has elevator access to the top with an observation tower.

The Statue of Liberty is a colossal copper sculpture, 151 feet tall, designed by Frederic Bartholdi. On Feb. 18, 1879 Bartholdi was issued U.S. Pat. No. 11,023 for a "Design for a Statue". The massive iron pylon and secondary skeletal framework, which allows the Statue's copper skin to move independently yet stand upright, was designed by Gustave Eiffel (the same Eiffel of the Eiffel Tower). There are stairs to an observation deck.

The St. Louis Arch is built of stainless-steel, spans 630 feet and soars 630 feet into the sky. It takes the shape of an inverted catenary curve. Each leg is an equilateral triangle with sides 54 feet long at ground level, tapering to 17 feet at the top. The legs have double walls of steel 3 feet apart at ground level and 7-¾ inches apart above the 400-foot level. Up to the 300-foot mark the space between the walls is filled with reinforced concrete. Beyond that point steel stiffeners are used. The double-walled, triangular sections were placed one on top of another and then welded inside and out to build the legs of the Arch. There is an observation tower at the top.

The Washington Monument is one of our oldest monuments, built from 1848 to 1884. It is 555 feet tall, and is almost like a giant finger in the sky. The walls are 15 feet thick at the base and 18 inches thick at the top. It is built of marble and has a sway of 0.125" in a 30 MPH wind. It has an elevator with access to an observation tower at the top.

The Stratosphere Tower in Las Vegas is 1150 feet tall and completed in 1996. The "tower" portion is built out of concrete. It has a restaurant—with other shops—at the top, elevator access, with other amusements—a chairlift and roller coaster—also at the top.

This Cross has similarities to each of these monument-attractions. The Eiffel Tower has a tremendous "x" brace configuration. It is at the same height as this Cross. "X" bracing is used profusely in this Cross, to wit: within the I-beam "cubes", within the arms of the Cross, and even to support the exterior stainless-steel panels. The Statue of Liberty has a copper "skin" with a massive iron pylon for support. In the Cross' case, the I-beam cubes support the exterior stainless-steel "skin". The St. Louis Arch is built of stainless-steel in the shape of inverted catenary curve. The similarity to the Cross lies in the "challenge of the curve" vs. the "challenge of the arms" as far as the engineers are concerned. The Washington Monument is like a finger in the sky. Yet it has only a sway of 0.125" in a 30 MPH wind at the top. This is an example of a stiff and stable object for the Cross to follow. The Stratosphere Tower is similar to the Cross in that it was built recently, is of like height, has a large area at the top for visitors and is unusual in its design.

RELATED PATENT

This application relates to my U.S. Pat. No. D440,734. However, the first patent is a design patent on a 1000 foot Cross, and the present application is for a utility patent.

SUMMARY OF INVENTION

As can be seen from the above "Prior Art", the present invention is similar to a number of prior monument-attractions. This Cross has three chapels at the top, with elevator access. However, this invention combines, in a way that has never been done before, I-beams, cables, and stainless-steel exterior.

The building is made up of I-beam "cubes". Within the upright portion of the structure are two sets of "x" brace I-beams. These stiffen the upright portion of the structure, allowing it to sustain high wind loads. There are also I-beam "x" braces in the arms to stiffen the arms.

The cables are in two distinct categories: exterior and interior. Some of the exterior cables support the building from the ground. Other exterior cables support the arms extending from the top of the structure to the tip of the arms. Some of the interior cables support the arms by transversing them from end to end to stabilize up and down movement. Other interior cables, "x" cables, stabilize side-to-side movement.

The stainless-steel "skin" is composed of sheets of stainless-steel, supported "x" braces.

Now a discussion of similar patents is in order. U.S. Pat. No. 4,638,609 is a rather interesting invention. The patent is by Csak and he has created a system for reducing the seismic load of tall buildings. "Cables are provided between the foundation and the superstructure and arranged in the vertical cavities of the foundation and the superstructure (Abstract) . . . " Here cables are being used to keep tall buildings from tipping over in seismic disturbances. In the Cross invention, cables are used to prevent the Cross from tipping over due to wind loads.

U.S. Pat. No. 5,208,932 is a cable-stay bridge. This has been patented by Muller, and is "a bridge of the cable-stay type, in particular of a very large span, the deck of which is supported by stays deflected by passing over towers (Abstract)." What is probably most similar to the 1000 foot Cross is the cables from the top of the Cross to the tip of the arms. This is similar to the cable-stays coming from the tower to the deck of the bridge. In both cases, the cables coming from a "tower" support a horizontal structure. U.S. Pat. No. 5,060,332, patented by Webster, is also a cable-stay bridge "which includes a pair of towers on either side of a gap and a roadway deck extending across the gap between the towers and cable stays fanning out from the top of each tower to separate longitudinally spaced load-bearing points on the decks (Abstract) . . . " The similarity to the 1000 foot Cross is identical to U.S. Pat. No. 5208932.

U.S. Pat. No. 5,848,499, patented by Schildge, Jr., pertains to a cable roof structure. This man definitely believed in his design, he has three almost identical patents on it—U.S. Pat. Nos. 4,802,314 and 5,010,695 being the other two. To quote from the Abstract: "A cable-stay retractable skylight roof and method of constructing the same wherein a large clear span is built over an existing or new athletic stadium or arena or other structure. The principal feature of the roof structure is that it is supported by Cable-Stays to towers standing outside of the stadium and places no vertical weight on the existing stadium." He has a tremendous cable structure to support this retractable stadium roof. He has tower arches outside the stadium to support the stadium roof. Clearly, there are certain similarities in the cable roof structure to the cable structure of the 1000 foot Cross. The "arm" cables of the Cross are like the cables to the roof framing. The ground-to-Cross cables are like the tower arch cables stretching to the ground in the cable roof structure.

U.S. Pat. No. 6,158,182, patented by Biebuyck, pertains to the building of a curtain wall. To quote from the Summary of Invention: "One aspect of the present invention comprises an apparatus for supporting a panel member of a curtain wall . . . In another aspect, the present invention comprises a method of installing a curtain wall . . . In a further aspect, the present invention comprises a curtain wall for a building." To the present invention, the similarities are thus: 1) purlins for supporting the stainless-steel panels, 2) lock bolts and welding for installing the "curtain wall", and 3) the stainless-steel "skin" of the Cross.

BRIEF DESCRIPTION OF THE DRAWINGS

Referring to the drawings which form a part of this disclosure.

DETAILED DESCRIPTION OF THE INVENTION

This is, as has been said before, a 1000 foot stainless-steel Cross. The three facets of the invention are the I-beam structure, the cable structure, and the stainless-steel "skin" structure.

Figure 1:
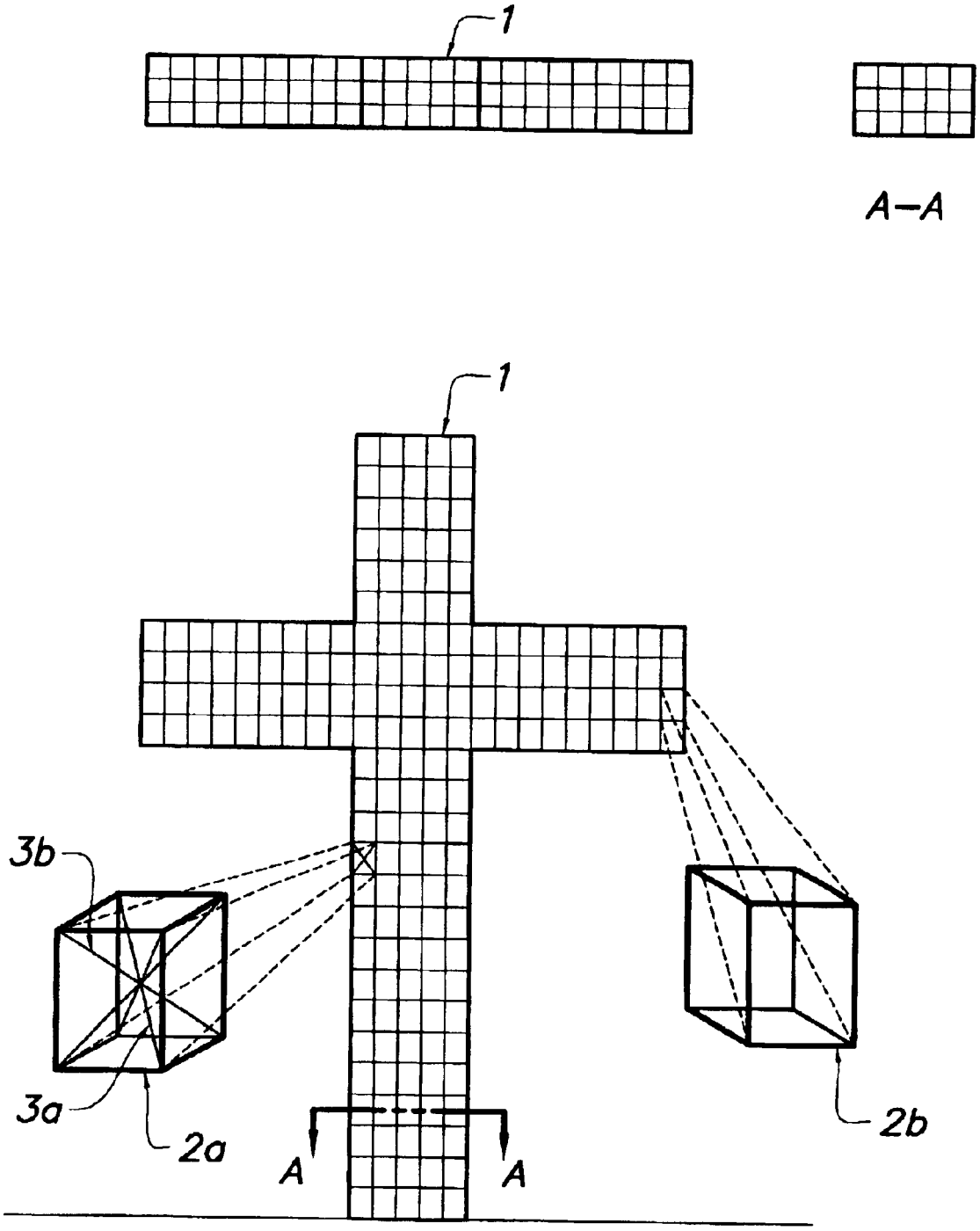
FIG. 1 shows a Front Elevation, with exploded views, of the I-beam "cube" structure, a Top View of the I-beam "cube" structure, and a cross-sectional view of the "tower" portion of the Cross.

FIG. 1 shows a Front Elevation of the I-beam structure. 1 denotes the Cross itself, with the I-beam "cubes". This I-beam structure is the same throughout the Cross, from front to back, and from top to bottom, although, obviously, like a skyscraper, the I-beams are heavier toward the bottom of the Cross. The Top View shows the I-beam structure, and again, is the same throughout the Cross, although heavier I-beams are at the bottom. 2*a* is an exploded view of an I-beam cube in the upright portion of the Cross. 3*a*,3*b* are internal I-beam "x" braces. The purpose of these is to stiffen the frame and provide resistance to the gale-type winds that blow in this area of Kansas. 2*b* is also an exploded view of an I-beam cube, although in the arm portion of the Cross, but without the internal I-beam supports due to the weight factor. A—A is the Cross-Sectional view of the Cross. As can be seen, the cross-section is identical to the Top View.

Figure 2:
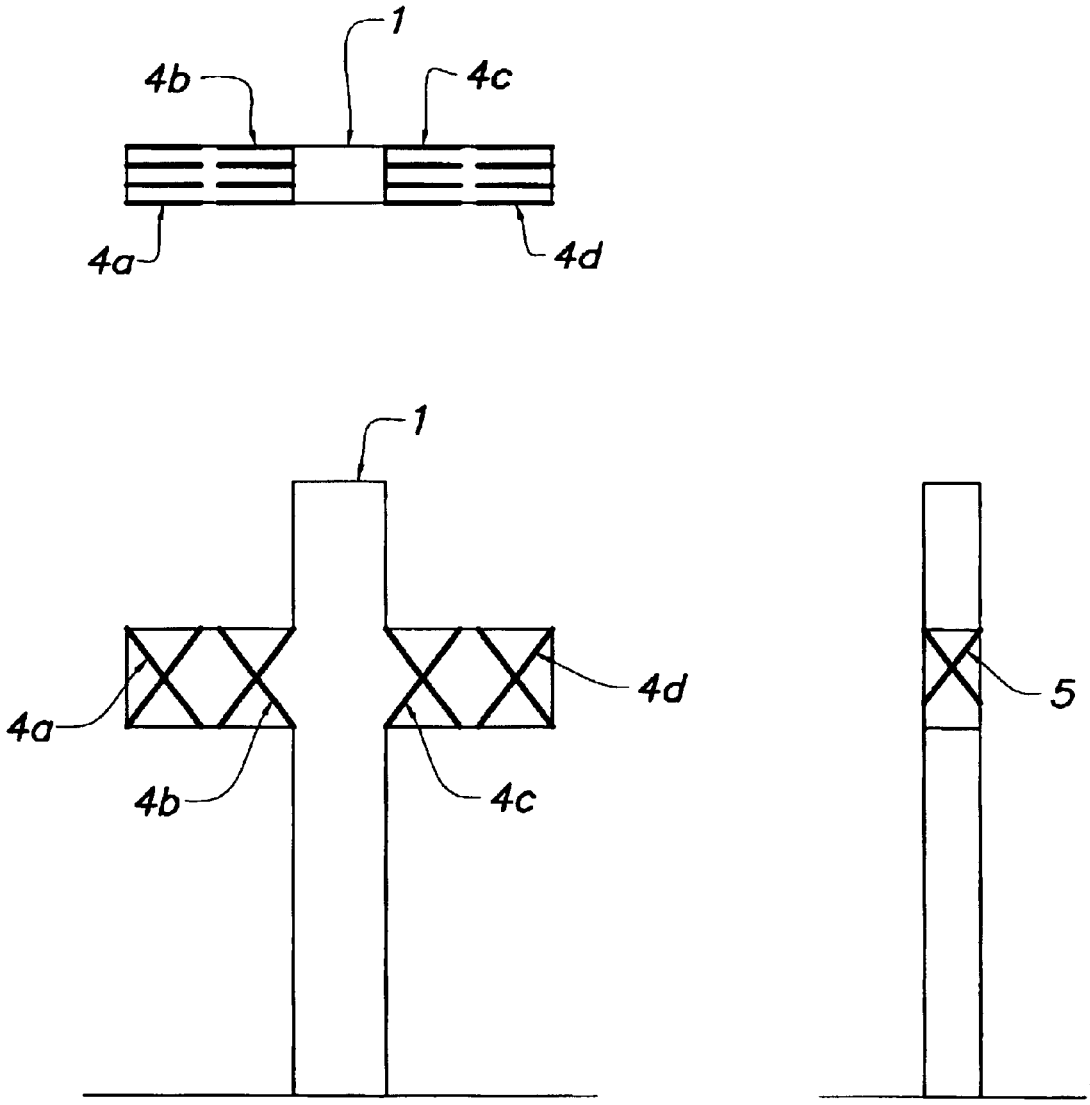
FIG. 2 shows a Front Elevation of the I-beam "x" braces in each arm, the Top View the same, and the Side Elevation shows the I-beam "x" brace at the end of the arm.

FIG. 2 shows the "x" brace I-beams for the arms. 4*a*,4*b*, 4*c*,4*d* show the I-beam "x" braces, in the Front Elevation. These are welded onto the I-beam cubes, as is seen in the Top View. The Side Elevation shows the one "x" brace I-beam on the end of each arm—5.

Figure 3:
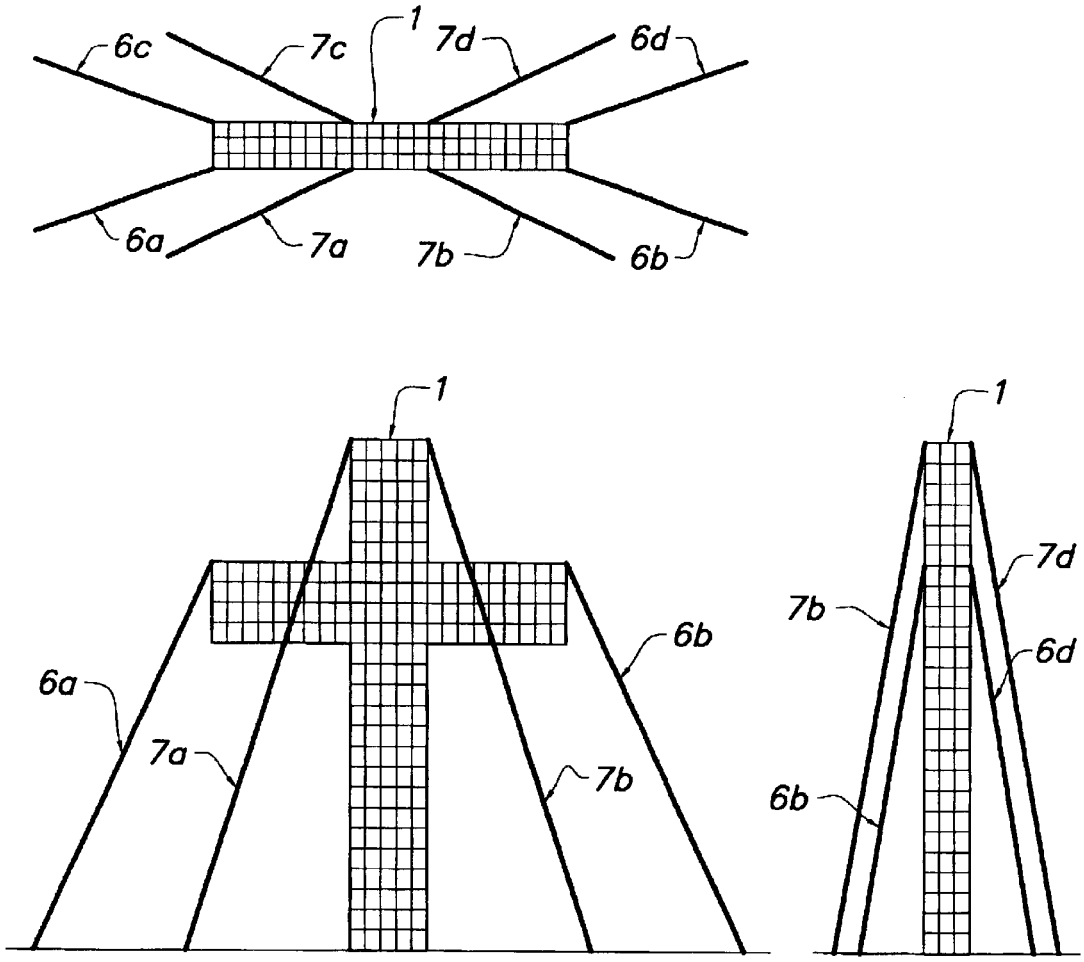
FIG. 3 shows a Front Elevation with various cable—arm-to-ground, top-to-ground—structure, a Top View of the same, and a Side Elevation of the same.

FIG. 3 shows the external cable structure. 1 denotes the Cross itself. 6*a*,6*b*,6*c*,6*d* denote the four cables from the ground to the tip of each arm. 7*a*,7*b*,7*c*,7*d* denote the four cables from the ground to the top of the Cross. The purpose of the ground-to-Cross cables is to strengthen, stabilize and economize the Cross. That is, with the severe winds, the cables keep the Cross from vibrating, swaying, etc. Because the Cross is not free-standing, but more like a television tower, or suspension bridge, the internal structure may be less stout, thereby cutting costs.

Figure 4:
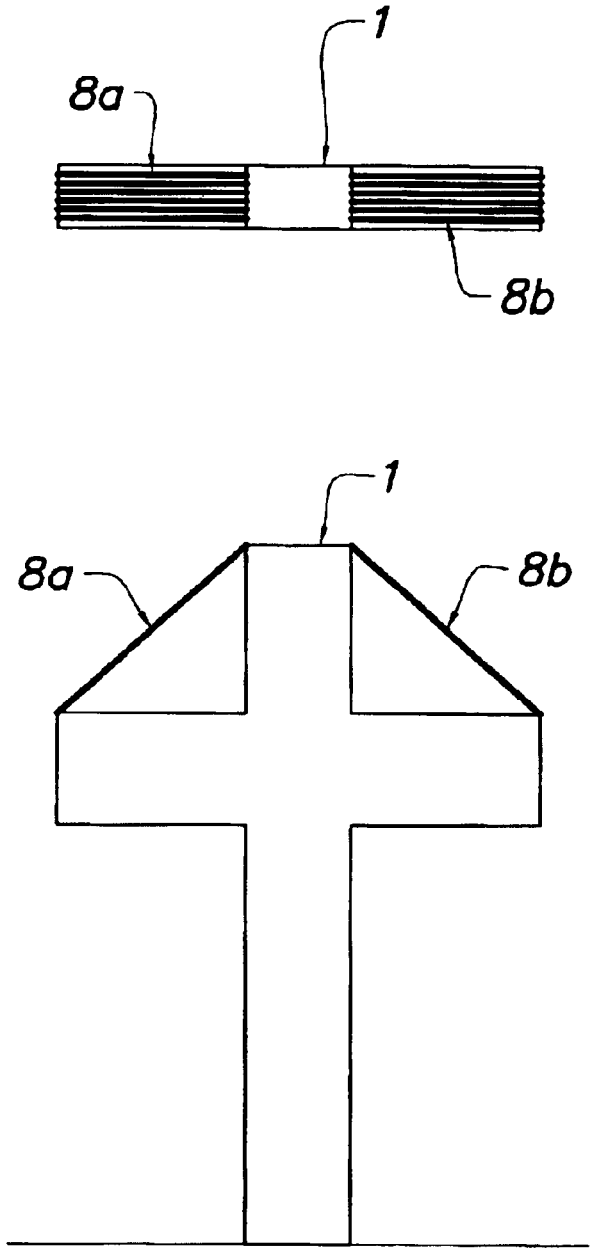
FIG. 4 shows a Front Elevation of the top-to-arm cable structure and a Top View of the same.

FIG. 4 concerns the cables from the tip of the arms to the top of the Cross. 1 denotes the Cross itself. 8*a*,8*b* denote the twelve cables from the tip of the arms to the top of the Cross; the purpose being to support the weight of the arm and diffuse the stress of this weight throughout the entire Cross structure.

Figure 5:
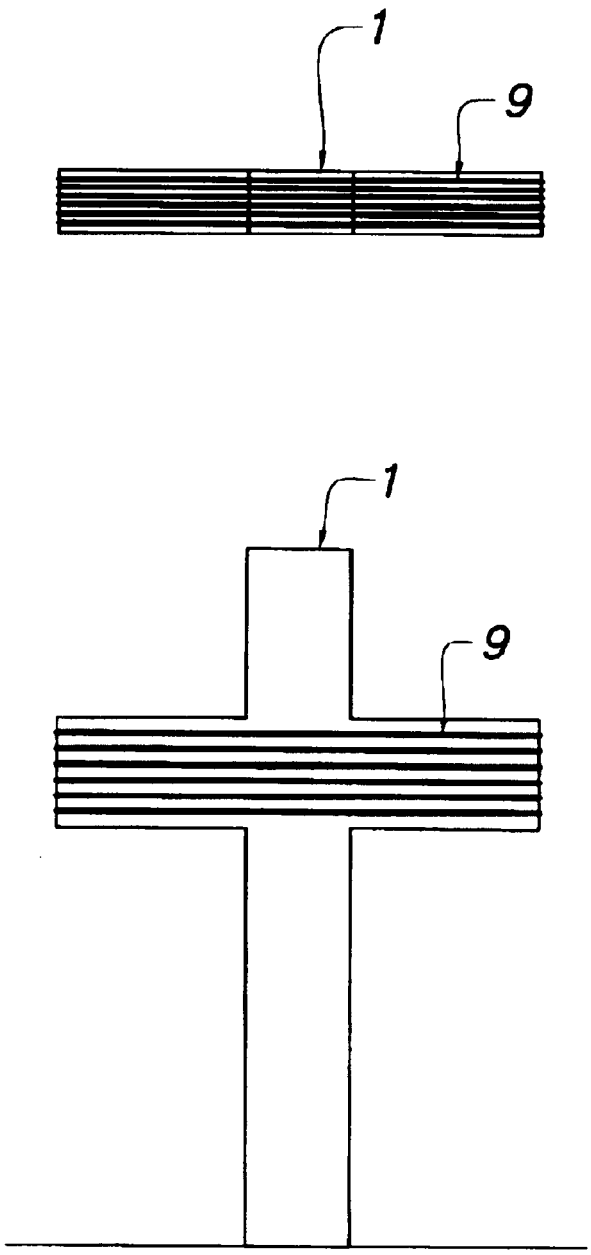
FIG. 5 shows a Front Elevation of the end-to-end arm cable structure and a Top View of the same.

FIG. 5 deals with some of the internal cable structure. Top View shows six cables stretching the entire length of the arms. Front Elevation shows six levels of cables stretching the entire length of the arms. 1 denotes the Cross itself. 9 denotes thirty-six cables stretching the entire length of the arms—690 feet. The purpose of such is "suck" each arm into the upright portion of the Cross, and to keep the arms from moving up and down.

Figure 6:
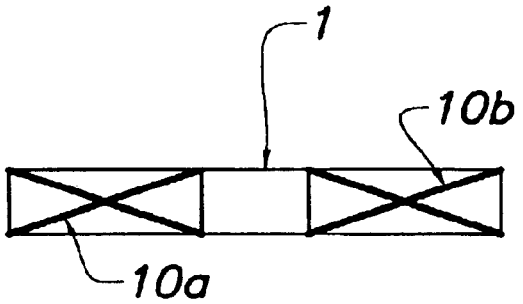
FIG. 6 shows a Front Elevation of the "x" brace cable structure and a Top View of the same.
Figure 6:
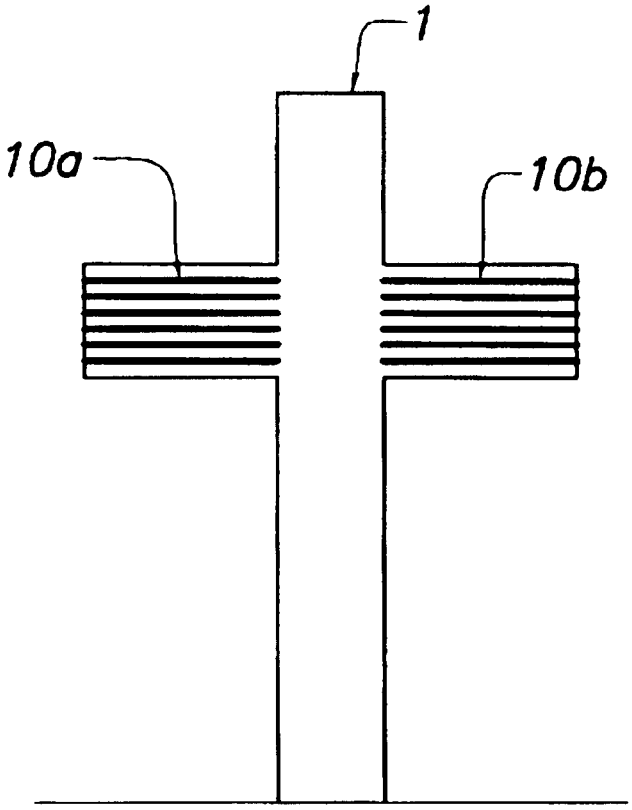

FIG. 6 deals with more of the internal cable structure. Top View shows two "x" cables. Front Elevation shows six levels of cables stretching from the end of the arm to the upright portion of the Cross. 1 denotes the Cross itself. 10*a*,10*b* denote twelve "x" cables stretching from the end of the arm to the upright portion of the Cross. In the actual construction, the "x" cables are not "true" "x" cables in that one part of the "x" passes just below the other part of the "x". Rubbing is kept to a minimum through the use of saddles.

Figure 7:
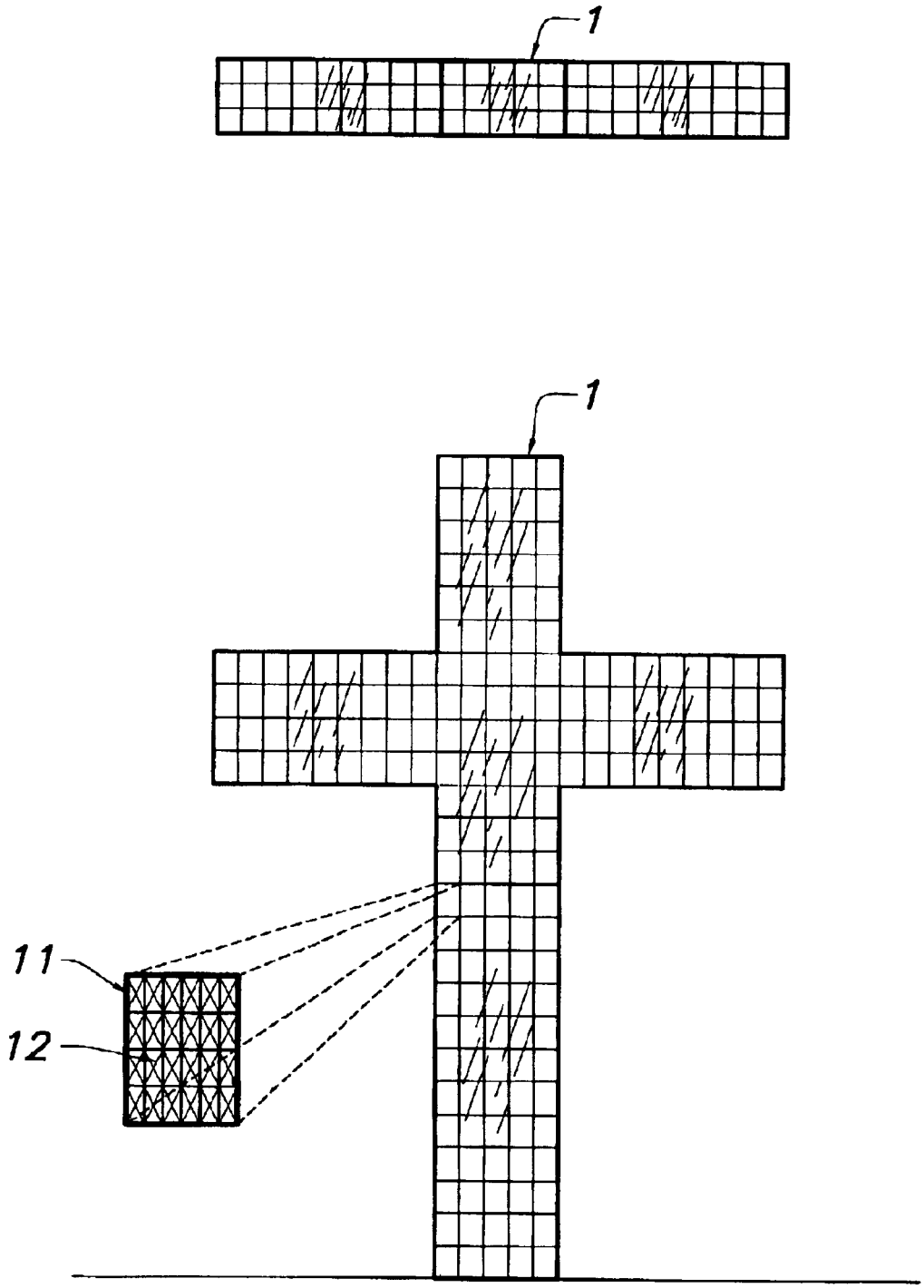
FIG. 7 shows a Front Elevation of the stainless-steel panels, with an exploded view, and a Top View of the same.

FIG. 7 denotes the stainless-steel. 1 denotes the Cross itself. 11 is an exploded view of the twenty-four stainless-steel panels per I-beam cube. 12 is "X" braces placed behind each panel as support against the elements, specifically the wind.

This is very unique structure utilizing a combination of construction techniques to produce a safe and sane structure. I-beams are blended in with cables to insure that the building will stand for many years. Stainless-steel for the exterior insures a pleasing finish.

What is claimed is:

1. A 1000 foot tower structure, comprising a rectangle, the long side vertical, tower arms, each arm on a horizontal plane, arms extending out of sides of tower, the structure configured in a cross shape; internally comprised of I-beam cubes, cubes being thicker and heavier at bottom of tower and thinner and lighter at top of tower, 375 tower cubes comprised of I-beams forming cubes, attached to each other by welds and bolts, with two "x"-braces, extending diagonally in opposite directions, comprised of I-beams, "x" being thicker and heavier at bottom of tower and thinner and lighter at top of tower, braces attached to cubes by welds and bolts, crossed and intersected at centers, when I-beams pass one through the other they are attached to each other by welds and bolts, 216 arm cubes comprised of I-beams forming cubes, attached to each other by welds and bolts, with "x"-brace structure comprised of I-beams attached to outside of cubes by welds and bolts, crossed and intersected at centers, when I-beams pass one through the other they are attached to each other by welds and bolts; I-beam cube structure including eight cables stretching externally from top of tower and tip of arms to ground, twelve cables stretching externally from top of tower to tip of arms, thirty-six cables stretching internally from one end of arm, through tower, to other end of arm, twenty-four cables stretching internally within each arm from end of arm to tower, configured in an "x" structure, one cable passing below other cable; I-beam cube structure including twenty-four rectangular stainless-steel panels on external structure per I-beam cube, with "x"-brace structure comprised of wind cross-braces attached to stainless-steel panels by lock bolts.

* * * * *